United States Patent [19]

Perkins

[11] 4,188,174

[45] Feb. 12, 1980

[54] WEAR RESISTANT VALVE

[75] Inventor: Gerald S. Perkins, Altadena, Calif.

[73] Assignee: California Institute of Technology, Pasadena, Calif.

[21] Appl. No.: 830,133

[22] Filed: Sep. 2, 1977

[51] Int. Cl.[2] ..... F04B 21/00; F04B 39/00

[52] U.S. Cl. ..... 417/432; 137/246.22

[58] Field of Search ..... 417/432, 433, 418; 137/246.22

[56] References Cited

U.S. PATENT DOCUMENTS

| | | | |
|---|---|---|---|
| 620,763 | 3/1899 | Fleuss | 417/433 |
| 1,194,687 | 8/1916 | Westinghouse | 417/432 |
| 2,067,819 | 1/1937 | Bell | 417/418 |
| 2,611,576 | 9/1952 | Storment | 137/246.22 |
| 2,622,838 | 12/1952 | Stevenson | 137/246.22 |
| 3,026,894 | 3/1962 | Brooks | 137/246.22 |
| 3,556,679 | 1/1971 | Middlebusher et al. | 417/317 |

FOREIGN PATENT DOCUMENTS

| | | | |
|---|---|---|---|
| 12003 | 4/1967 | Japan | 92/129 |
| 1426519 | 3/1976 | United Kingdom | 137/246.22 |
| 182992 | 7/1966 | U.S.S.R. | 417/432 |

*Primary Examiner*—William L. Freeh

*Attorney, Agent, or Firm*—Freilich, Hornbaker, Wasserman, Rosen & Fernandez

[57] ABSTRACT

A valve which is resistant to wear caused by particles trapped between the valve seat and the valve member or poppet when the valve closes, including an outlet for directing washing fluid at the valve seat and/or sealing face of the poppet and means for supplying pressured fluid to the outlet at the time when the valve is closing.

4 Claims, 6 Drawing Figures

WEAR RESISTANT VALVE

ORIGIN OF THE INVENTION

The invention described herein was made in the performance of work under a NASA contract and is subject to the provisions of Section 305 of the National Aeronautics and Space Act of 1958, Public Law 85-568 (72 Stat. 435; 42 USC 2457).

BACKGROUND OF THE INVENTION

This invention relates to valves, and to an improved wear resistant valve.

The life of a valve is largely determined by the wear of the valve seat and of the sealing face of the poppet which must press against the valve seat to close the valve. In certain systems where very high pressures and abrasive material are encountered, the life of the valves may be a prime factor in determining the feasibility of the system. For example, in drilling hydrocarbon wells and the like, it has been found that the drill rate can be greatly increased by increasing the pressure of the mud-water drilling fluid from a typical pressure such as 3,000 psi to a very high pressure such as 15,000 psi. However, it was found that the pumping equipment has a much shorter lifetime at such high pressures, particularly for the pump and its valves. My earlier patent application Ser. No. 774,229 filed Mar. 4, 1977, describes a reciprocating mud pump for producing high pressures, which pumps a large volume with each stroke to minimize the number of times the valves must open and close, to thereby increase the valve life. My co-pending patent application entitled Fast Acting Check Valve describes the use of a solenoid to rapidly close a check valve so as to reduce the time during which rapid regurgitant flow occurs past the valve seat. Any additional steps which could increase the life of the valves would make the utilization of high drilling fluid pressures more economical.

SUMMARY OF THE INVENTION

In accordance with one embodiment of the present invention, a valve is provided which wears more slowly than usual. The valve includes a washing fluid outlet positioned to produce a stream of fluid along the valve seat and/or sealing face of the poppet, and means for pumping fluid through the outlet during the time when the poppet is closing against the valve seat, to wash away material that has been flowing through the valve so as to reduce the amount of such material which will be trapped between the poppet and valve seat when the valve is completely closed.

The novel features of the invention are set forth with particularity in the appended claims. The invention will best be understood from the following description when read in conjunction with the accompanying drawings.

DESCRIPTION OF THE PREFERRED EMBODIMENTS

Figure 1:
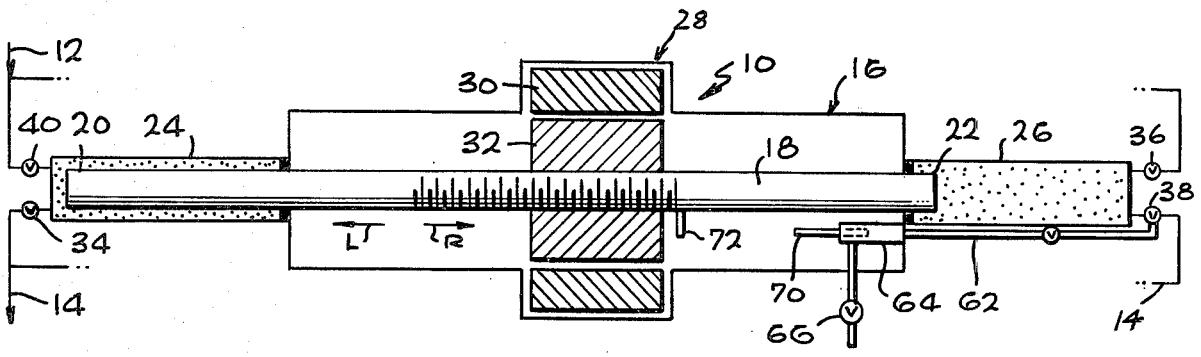
FIG. 1 is a simplified sectional view of a pump and valve system constructed in accordance with the present invention.

FIG. 1 illustrates a pumping system 10 which receives a drilling fluid through an input line 12, and which delivers the fluid through an output line 14 at very high pressure. Pumping is accomplished by a pump 16 which includes a long piston 18 whose end portions 20, 22 are received in chambers or cylinders 24, 26. The piston is reciprocated by an electric motor 28 which includes a stator 30 and a rotor 32, the rotor being threadably connected to a threaded middle portion of the piston. When the piston is moving in the direction of arrow L, fluid is pumped out of the cylinder 24 and into an outlet conduit along which an outlet check valve 34 is positioned, to the outlet line 14. At the same time, the other cylinder 26 receives fluid from an inlet check valve 36. Conversely, when the piston starts moving in the other direction as indicated by arrow R, fluid is pumped out of cylinder 26 through another outlet check valve 38, while the cylinder 24 is receiving fluid from inlet check valve 40.

Figure 2:
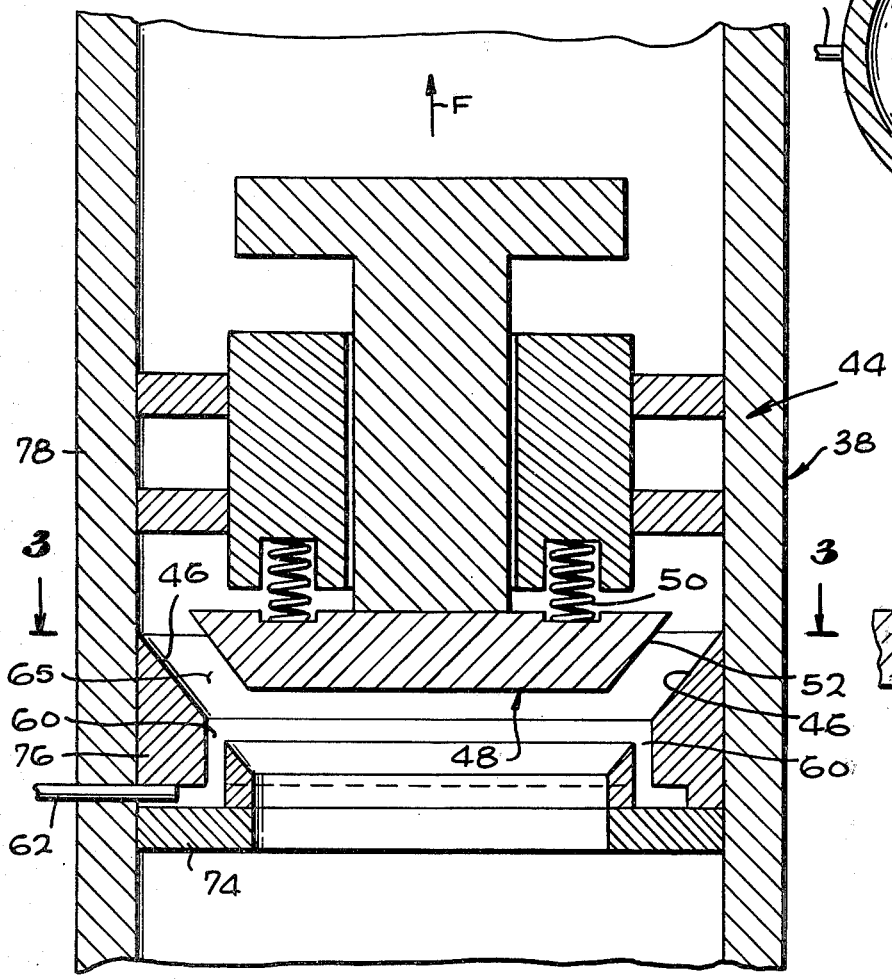
FIG. 2 is a sectional side view of one of the valves of the system of FIG. 1.
Figure 3:
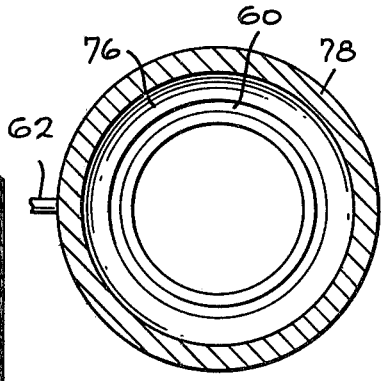
FIG. 3 is a view taken on the line 3—3 of FIG. 2.

FIG. 2 illustrates details of the outlet check valve 38 which allows fluid flow substantially only in the direction of arrow F. The valve includes a housing 44, walls forming a valve seat 46 in the housing, and a valve member or poppet 48 which can move against and away from the valve seat 46. A group of springs 50 urge the poppet 48 towards the valve seat so that a sealing portion 52 of the poppet seals against the valve seat. The pumped mud-water mixture contains abrasive particles, and on closure of the valve such particles are clamped between the poppet and valve seat with great force. Such particle clamping over numerous cycles of valve operation, produce considerable erosion and wear.

In accordance with the present invention, a washing fluid outlet 60 is provided which can direct a washing fluid such as water into the space between the sealing portion 52 of the poppet and the valve seat 46. The washing fluid outlet 60 is connected through a water injection line 62 that is connected (FIG. 1) to a secondary pump 64. The pump 64 receives clean water through an inlet 66 and pumps the water at high pressure through the injection line 62 and outlet 60, during the time when the poppet 48 is closing. The washing fluid is pumped through the outlet 60 at a pressure higher than the pressure of the mud on either side of the valve seat, so that the washing fluid pushes away mud lying in the space 65 between the poppet sealing portion 62 and the valve seat 46. For example, where a mud water mixture is being pumped by the high pressure reciprocating main pump 16 at a maximum pressure of 20,000 psi, water at the outlet 60 may be pumped at a pressure such as 21,000 psi which is sufficient to vigorously wash away mud.

The timing of operation of the washing fluid pump 64, to cause pumping at the right time during each cycle of valve operation, can be achieved by allowing the large mud pumping piston 16 to operate the pump 64. The pump 64 is a parasitic pump with a piston or plunger 70 in the path of a push rod 72 that is mounted on the mud pump piston. The push rod 72 and plunger 70 are positioned so that the plunger 70 is pushed as the piston approaches one end of its extreme path of travel to then cause the injection of washing fluid into the check valve. It may be noted that the power required to operate the parasitic pump 64 is here utilized to help stop movement of the large piston 16 to facilitate its reversal of motion.

Figure 4:
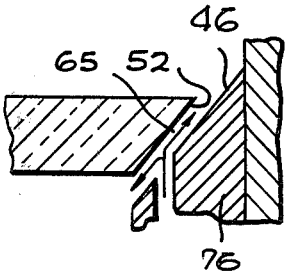
FIG. 4 is an enlarged view of a portion of the valve of FIG. 2, shown immediately prior to valve closure.

The washing fluid outlet 60 is of annular shape so that washing of the sealing faces is conducted around the entire valve. This is accomplished by constructing the valve housing utilizing a pair of separate members 74, 76 that are joined to one another and to a cylindrical member 78 of the housing. The location of the outlet 60 in the middle of the valve seat results in the need to push away mud only a small distance, in opposite directions away from the middle of the region between the poppet and valve seat, as indicated in FIG. 4. However, outlets can be provided in a variety of positions, such as at the radially inner or outer end of the valve seat.

Figure 5:
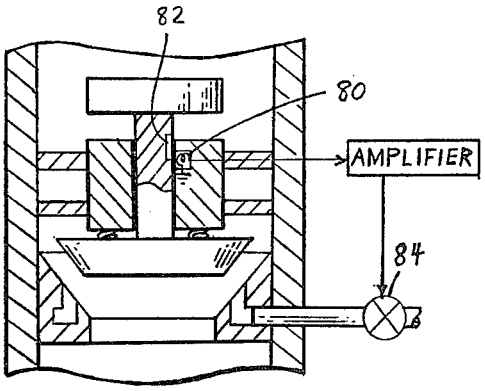
FIG. 5 is a sectional side view of a valve constructed in accordance with another embodiment of the invention.
Figure 6:
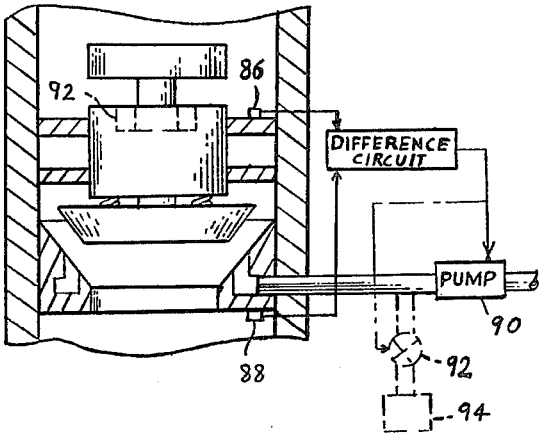
FIG. 6 is a sectional side view of a valve constructed in accordance with another embodiment of the invention.

The use of a parasitic pump operated by the large piston of the mud pump, provides a simple construction for energizing the washing fluid pump and also properly timing it. However, it is possible to utilize a variety of other means for supplying high pressure water or other washing fluid at the proper time. For example, a device 80 (FIG. 5) such as a coil which generates a current when a magnet 82 on the poppet moves past it, could be utilized which senses when the poppet begins closing, to open a valve 84 that connects a high pressure water supply to the washing fluid outlet. Where it is necessary to begin preparing for the supplying of water to the outlet before the poppet begins closing, other sensors can be used. For example, FIG. 6 shows a pair of pressure transducers 86, 88 that are positioned on opposite sides of the valve seat to determine when the check valve will begin closing, and to energize an electric solenoid-driven high pressure pump 90 at that time, or to open an outlet valve indicated at 92 from a high pressure source 94 at that time. Of course, it is possible to inject washing fluid during a period considerably prior to closing of the valve, although this would result in waste of pumping energy. For valves that are not check valves, but which are closed by any of a variety of known mechanisms such as a solenoid indicated at 92, washing fluid can be pumped in at the time the operating mechanism which moves the poppet closed is operated.

Where a parasitic pump or the like is utilized with the mud pump of FIG. 1, it is possible to connect the water injection line 62 not only to the outlet check valve 38, but also to the inlet check valve 40 through which mud is flowing into the opposite cylinder 24, and which will close at substantially the same time as the outlet valve 38 will close. The inlet valve 40 can have the same construction as outlet valve 38. Either another parasitic pump can be provided for the other valves 34, 36 or a mechanism can be provided to operate the parasitic pump 64 when the large mud pumping piston 18 approaches its other extreme of travel and to connect the injection line 62 to the other valves 34, 36.

Thus, the invention provides apparatus for minimizing wear on a valve, especially where abrasive particles are present in fluid flowing through the valve. This is accomplished by means for directing a washing fluid into the space between the poppet and valve seat at least at a time immediately prior to closing of the poppet against the valve seat. The mechanism can include a washing fluid outlet formed in the valve seat, to direct fluid in opposite directions away from the center of the valve seat. The fluid can be supplied at high pressure and at the proper time, in a system wherein the valve controls fluid from a reciprocating pump, by operating the pump or allowing the outflow of washing fluid from a high pressure source to the washing fluid outlet, at a time when the pump is near an extreme of its travel.

Although particular embodiments of the invention have been described and illustrated herein, it is recognized that modifications and variations may readily occur to those skilled in the art, and consequently, it is intended that the claims be interrupted to cover such modifications and equivalents.

What is claimed is:

1. A fluid pump system comprising:

a main pump which includes a main cylinder with an outlet, and a main piston movable in the cylinder towards said outlet to pump material which lies in said cylinder out of said outlet;

a valve connected to said main cylinder outlet, including walls forming a valve seat, and a valve member with a seat-engaging portion movable against and away from said valve seat; and means for directing a washing fluid into the space between said valve member portion and said valve seat at a time immediately prior to closing of said valve member portion against said valve seat, including a washing fluid outlet positioned to direct a washing fluid into said space, a secondary pump which includes a secondary cylinder and a secondary piston movable in said secondary cylinder to pump washing fluid toward said washing fluid outlet, and means for coupling said main piston to said secondary piston only near the end of the stroke of said main piston as it approaches said outlet of said main cylinder, to then begin moving said secondary piston to pump said washing fluid.

2. A fluid pump system comprising:

a main pump which includes a main cylinder with an outlet, a main piston movable in said cylinder, and means for cyclically reciprocating said piston between predetermined extreme positions, said piston pumping material through said outlet as it approaches a first of said extreme positions;

a valve connected to said main cylinder outlet, including walls forming a valve seat, and a valve member with a seat-engaging portion movable against and away from said valve seat; and means responsive to the position of said main piston for directing a washing fluid into the space between said valve member portion and said valve seat beginning when said main piston is approaching and lies near said first position.

3. The system described in claim 2 wherein:

said fluid directing means includes a secondary pump having a secondary cylinder and a secondary piston movable in said secondary cylinder and having a secondary piston portion in the path of said main piston when said main piston is near said first extreme position, so that said main piston moves said secondary piston to pump said washing fluid as said main piston approaches said first extreme position.

4. The system described in claim 2 wherein:

said main pump includes a second cylinder receiving an end of said main piston which is opposite the end received in said first named main cylinder, and an inlet check valve which delivers fluid to said second cylinder as said main piston moves further into said first named cylinder, said inlet valve having a valve seat and valve member which moves against it; and said fluid directing means directs fluid into the space between said seat and valve member of said inlet valve at substantially the same time as it directs fluid into said space of said outlet valve.

* * * * *